United States Patent [19]

Clem et al.

[11] Patent Number: 4,872,967

[45] Date of Patent: Oct. 10, 1989

[54] MULTISTAGE REFORMING WITH INTERSTAGE AROMATICS REMOVAL

[75] Inventors: Kenneth R. Clem, Baton Rouge, La.; Kenneth J. Heider, Oak Ridge; James E. Kegerreis, Montville, both of N.J.; Ehsan I. Shoukry, Baton Rouge, La.

[73] Assignee: Exxon Research and Engineering Company, Florham Park, N.J.

[21] Appl. No.: 197,233

[22] Filed: May 23, 1988

[51] Int. Cl.[4] ..... C10G 35/06

[52] U.S. Cl. ..... 208/65; 585/819

[58] Field of Search ..... 208/65; 585/819

[56] References Cited

U.S. PATENT DOCUMENTS 2,933,445 4/1960 Donnell et al. ..... 208/64
3,883,418 5/1975 Drehman et al. ..... 208/65
4,115,465 9/1978 Elfert et al. ..... 585/819
4,627,909 12/1986 Robinson ..... 208/65

OTHER PUBLICATIONS

Pines, *The Chemistry of Catalytic Hydrocarbon Conversions*, Academic Press, (1981), pp. 102–104.

*Primary Examiner*—Curtis R. Davis
*Attorney, Agent, or Firm*—Henry E. Naylor

[57] ABSTRACT

Disclosed is a process for catalytically reforming a gasoline boiling range hydrocarbonaceous feedstock wherein the reforming is conducted in two or more stages wherein each stage is separated from another stage by aromatics removal from the reaction stream of a preceding stage. The resulting aromatics-lean stream is passed to a downstream reforming stage.

34 Claims, 1 Drawing Sheet

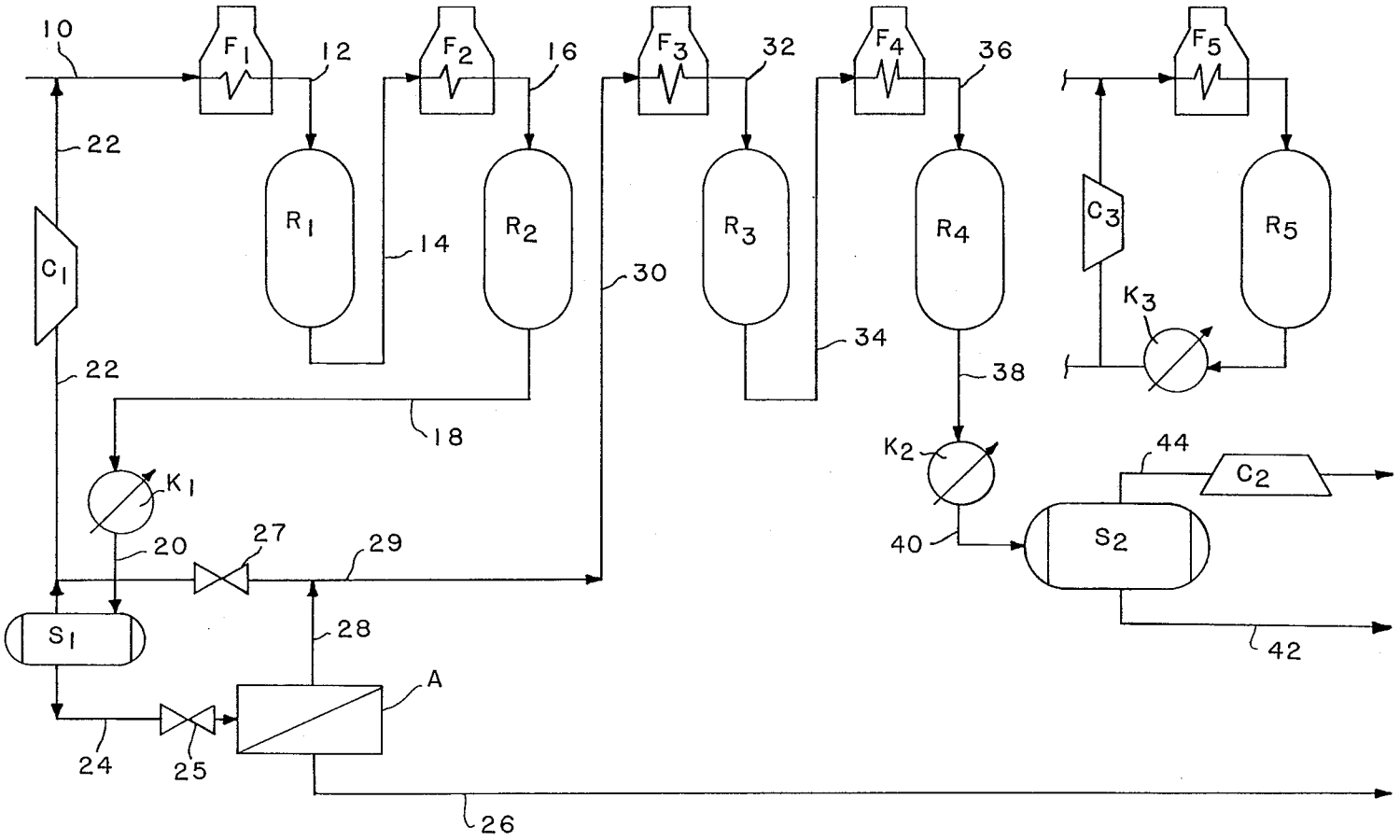
F1
F2
F3
F4
F5
R1
R2
R3
R4
R5
C1
C2
C3
K1
K2
K3
S1
S2
A
10
12
14
16
18
20
22
22
24
25
26
27
28
29
30
32
34
36
38
40
42
44

MULTISTAGE REFORMING WITH INTERSTAGE AROMATICS REMOVAL

CROSS REFERENCE TO RELATED APPLICATIONS

The present invention relates to a process for catalytically reforming a gasoline boiling range hydrocarbonaceous feedstock. The reforming is conducted in multiple stages with aromatics separation between stages.

BACKGROUND OF THE INVENTION

Catalytic reforming is a well established refinery process for improving the octane quality of naphthas or straight run gasolines. Reforming can be defined as the total effect of the molecular changes, or hydrocarbon reactions, produced by dehydrogenation of cyclohexanes, dehydroisomerization of alkylcyclopentanes, and dehydrocyclization of paraffins and olefins to yield aromatics; isomerization of n-paraffins; isomerization of alkylcycloparaffins to yield cyclohexanes; isomerization of substituted aromatics; and hydrocracking of paraffins which produces gas, and inevitably coke, the latter being deposited on the catalyst. In catalytic reforming, a multifunctional catalyst is usually employed which contains a metal hydrogenation-dehydrogenation (hydrogen transfer) component, or components, usually platinum, substantially atomically dispersed on the surface of a porous, inorganic oxide support, such as alumina. The support, which usually contains a halide, particularly chloride, provides the acid functionality needed for isomerization, cyclization, and hydrocracking reactions.

Reforming reactions are both endothermic and exothermic, the former being predominant, particularly in the early stages of reforming with the latter being predominant in the latter stages. In view thereof, it has become the practice to employ a reforming unit comprised of a plurality of serially connected reactors with provision for heating of the reaction stream from one reactor to another. There are three major types of reforming: semiregenerative, cyclic, and continuous. Fixed-bed reactors are usually employed in semiregenerative and cyclic reforming and moving-bed reactors in continuous reforming. In semiregenerative reforming, the entire reforming process unit is operated by gradually and progressively increasing the temperature to compensate for deactivation of the catalyst caused by coke deposition, until finally the entire unit is shutdown for regeneration and reactivation of the catalyst. In cyclic reforming, the reactors are individually isolated, or in effect swung out of line, by various piping arrangements. The catalyst is regenerated by removing coke deposits, and then reactivated while the other reactors of the series remain on stream. The "swing reactor" temporarily replaces a reactor which is removed from the series for regeneration and reactivation of the catalyst, which is then put back in the series. In continuous reforming, the reactors are moving-bed reactors, as opposed to fixed-bed reactors, with continuous addition and withdrawal of catalyst and catalyst is regenerated in a separate regeneration vessel.

Through the years, many process variations have been proposed to improve such things as $C_5+$ liquid (a relatively high octane product stream) yield and/or octane quality of the product stream from catalytic reforming. For example, if a product of high octane is desired, e.g. 100 or higher RON (research octane number), the severity of reforming must be increased. This can generally be accomplished by reducing the space velocity or increasing reaction temperature. While increased severity for obtaining a higher octane product is desirable, it has disadvantages. For example, high severity usually: (i) reduces the yield of $C_5+$ as a percent of the naphtha feedstock; (ii) usually causes more rapid accumulation of coke on the catalyst, thus rapidly decreasing the activity of the catalyst and requiring more frequent regeneration.

Practice of the present invention results in a significantly higher yield of hydrogen and of $C_5+$ liquid as a percent of the naphtha feedstock. This is achieved by conducting the reforming in multiple stages and separating an aromatics-rich (high octane) stream between stages. The separation is performed after reforming at low severity, in a first stage or stages, to convert most of the alkycyclohexanes and alkylcyclopentanes to aromatics with minimum conversion, especially cracking, of paraffins. The remaining paraffin-rich, or aromatics-lean stream is processed in the downstream stage, or stages, at relatively high severity and preferably at relatively low pressures.

While there are some references in the art teaching aromatics removal between and after reactors of a reforming process unit, none suggests aromatics removal, after low severity catalytic reforming using a multimetallic catalyst followed by relatively high severity reforming, at low pressures.

For example, U.S. Pat. No. 2,970,106 teaches reforming to a relatively high octane (99.9 RON) followed by two stage distillation to produce three different streams: a light, intermediate, and heavy boiling stream. The intermediate stream, which contains $C_7$ and $C_8$ aromatics, is subjected to permeation by use of a semipermeable membrane resulting in an aromatics-rich stream and an aromatics-lean stream, both of which are distilled to achieve further isolation of aromatics. It is also taught that the aromatics-lean stream from the permeation process may be combined with a low octane stream from hydroformate distillation and further hydroformed, or isomerized, to improve octane number. It is further taught that the total hydroformate may be processed using the permeation process. Partial or low severity reforming, followed by aromatics separation, followed by further reforming with a stream containing a significant fraction of the paraffins in the original feedstock is not suggested in U.S. Pat. No. 2,970,106. Operation of the first-stage at high octane (99.9 RON) would result in very high conversion of feed paraffins. For example a key paraffin, n-heptane and its various isomers, would be about 46 to 54% converted at 99.9 RON for a petroleum naphtha cut (185°/330° F.) comprised of 59% paraffins, 27% naphthenes, and 14% aromatics, which percents are liquid volume percent on total paraffins, naphthenes and aromatics present in the feed. In accordance with the process of the present invention, conversion of the n-heptane and its various isomers would be only about 11 to 14% in the first reforming stage-thus allowing more selective (less paraffin cracking) conversion to aromatics in the lower pressure second-stage.

Also, U.S. Pat. No. 3,883,418 teaches reforming a feedstock in the presence of hydrogen over a bifunctional catalyst in a first stage to convert naphthenes to aromatics, followed by distillation of the first stage product to produce an intermediate boiling (120°–260°

F.) material which is subjected to extractive distillation to produce an aromatics-rich extract and an aromatics-lean raffinate. The aromatics-lean, or paraffins-rich, raffinate is then reformed in the presence of steam over a steam-stable catalyst. Steam reforming employs a steam reaction atmosphere in the presence of a catalyst having a relatively low surface area aluminate support material. Reforming, in accordance with the present invention, employs a hydrogen reaction atmosphere, in the substantial absence of steam, and in the presence of a catalyst having a relatively high surface area support material, such as gamma alumina.

Further, U.S. Pat. No. 4,206,035 a process similar to U.S. Pat. No., 3,883,418, except that solvent extraction is used to remove aromatics instead of extractive distillation, and the aromatics-lean fraction sent to steam reforming is restricted to carbon numbers between 5 and 9. Also, specific hydrogen to hydrocarbon ratios and steam to hydrocarbon ratios are required.

U.S. Pat. No. 2,933,445 teaches a catalytic reforming process wherein the entire feedstock is first fractionated. The resulting 140° to 210° F. and 260° to 420° F. fractions are reformed in the presence of hydrogen in parallel reformers. In the reforming of the 140° to 210° F. fraction, the reforming severity is set such that naphthenes are converted to benzene and toluene and the resulting reformate is treated to remove aromatics. The remaining stream, containing at least 80 percent paraffins (primarily those containing 6 and 7 carbon atoms) is blended with the heavy 260° to 420° F. fraction and reformed in a second reformer. This reference teaches restricting the hydrocarbons reformed prior to aromatics removal to only the light naphtha components which form $C_6$ and $C_7$ aromatics. In addition, it teaches further reforming of the light paraffin-rich stream remaining after aromatics removal, in admixture with a heavy feed which is rich in aromatics and naphthenes.

Further, U.S. Pat. No. 3,640,818 teaches a process wherein virgin and cracked naphthas are reformed in a first stage and the reaction stream passed to solvent extraction where aromatics are removed. The paraffinic-rich raffinate is passed to second stage reforming, preferably at pressures the same or higher than the first stage.

SUMMARY OF THE INVENTION

In accordance with the present invention, there is provided a process for catalytically reforming a gasoline boiling range hydrocarbon feedstock in the presence of hydrogen in a reforming process unit comprised of a plurality of serially connected reactors wherein each of the reactors contains a noble metal-containing reforming catalyst composition, the process comprising:

(a) conducting the reforming in two or more stages comprised of one or more reactors;

(b) separating at least a portion of the reaction stream between each stage into an aromatics-rich and an aromatics-lean stream;

(c) passing at least a portion of the aromatics-lean stream to the next downstream stage; and (d) conducting the reforming of one or more downstream stages at a pressure lower than the first stage wherein at least one reactor of one or more of the downstream reactors contains multimetallic Pt-containing reforming catalyst.

In preferred embodiments of the present invention, one or more of the downstream stages are operated such that gaseous products are not recycled.

In other preferred embodiments of the present invention, separation of the reaction stream into an aromatics-rich and an aromatics-lean stream is accomplished by permeation using a semipermeable membrane, adsorption, distillation, or extraction.

In another preferred embodiment of the present invention, separation of the product stream is accomplished by use of a semipermeable membrane comprised of a material selected from the group consisting of polyureas, polyurethanes, and polyurea/urethanes.

In yet other preferred embodiments of the present invention, the catalyst composition of the one or more downstream stages is comprised of a Group VIII noble metal, a halide, an inorganic oxide support, and one or more promoter metals selected from those of Groups IIIA, IVA, IB, VIB, and VIIB of the Periodic Table of the Elements.

In still other preferred embodiments of the present invention, the noble metal is platinum, the halide is chloride, and the inorganic oxide support is alumina.

Other preferred embodiments include a catalyst comprised of a noble metal on a crystalline aluminosilicate support.

In yet another preferred embodiment of the present invention, the reforming process unit contains two stages, wherein the first stage is operated in semiregenerative mode and the second stage is operated in cyclic mode.

BRIEF DESCRIPTION OF THE FIGURE

The sole figure hereof depicts a simplified flow diagram of a preferred reforming process unit of the present invention. The reforming process unit is comprised of a first stage which includes a lead reactor and a first downstream reactor operated in semiregenerative mode, wherein the reaction stream of the first stage is separated into an aromatics-rich stream and an aromatics-lean stream. The aromatics-lean stream is passed to a second reforming stage which includes two serially connected downstream reactors operated in cyclic mode with a swing reactor.

DETAILED DESCRIPTION OF THE INVENTION

Feedstocks which are suitable for reforming in accordance with the instant invention are any hydrocarbonaceous feedstocks boiling in the gasoline range. Nonlimiting examples of such feedstocks include the light hydrocarbon oils boiling from about 70° F. to about 500° F., preferably from about 180° F. to about 400° F., for example straight run naphtha, synthetically produced naphtha such as a coal or oil-shale derived naphtha, thermally or catalytically cracked naphtha, hydrocracked naphtha, or blends or fractions thereof.

Referring to the figure, a feedstock, which preferably is first hydrotreated by any conventional hydrotreating method to remove undesirable components such as sulfur and nitrogen, is passed to a first reforming stage represented by heater or preheat furnaces $F_1$ and $F_2$, and reactors $R_1$ and $R_2$. A reforming stage, as used herein, is any one or more reactors and its associated equipment (e.g., preheat furnaces etc.) separated from an immediately preceding or succeeding stage by the separation of aromatics from the reaction stream of the preceding stage. The feedstock is fed into heater, or preheat furnace, $F_1$ via line 10 where it is heated to an effective reforming temperature. That is, to a temperature high enough to initiate and maintain dehydrogenation reactions, but not so high as to cause excessive hydrocracking. The heated feedstock is then fed, via line 12, into reactor $R_1$ which contains a catalyst suitable for reforming. Reactor $R_1$, as well as all other reactors in the process unit, is operated at reforming conditions. Typical reforming operating conditions that can be used for any of the reactors of any of the stages hereof are such that the reactor inlet temperature is from about 800° to about 1200° F.; the reactor pressure from about 30 psig to about 1,000 psig, preferably from about 30 psig to about 500 psig; a weight hourly space velocity (WHSV) of about 0.5 to about 20, preferably from about 1 to about 10; and a hydrogen to oil ratio of about 1 to 10 moles of hydrogen per mole of $C_5$+ feed.

The reaction product of reactor $R_1$ is fed to preheat furnace $F_2$ via line 14, then to reactor $R_2$ via line 16. The reaction product from the first stage is sent to cooler $K_1$ via line 18 where it is cooled to condense the liquid to a temperature within the operating range of the aromatics separation unit. This temperature will generally range from about 100° to about 300° F. The cooled reaction product is then fed to separator $S_1$ via line 20 where a lighter gaseous stream is separated from a heavier liquid stream. The gaseous stream, which is hydrogen-rich, is recycled, via line 22, to line 10 by first passing it through compressor $C_1$ to increase its pressure to feedstock pressure. Of course, during startup, the unit is pressured-up with hydrogen from an independent source until enough hydrogen can be generated in the first stage, or stages, for recycle. It is preferred that the first stage be operated in semiregenerative mode.

The liquid fraction from separator $S_1$ is passed via line 24, through pressure reduction valve 25, to aromatics separation unit A where aromatic materials are separated, thus resulting in an aromatics-rich and an aromatics-lean stream. The terms "aromatic-rich" and "aromatics-lean" as used herein refer to the level of aromatics in the liquid fraction reaction stream after aromatics separation relative to the level of aromatics prior to separation. That is, after a reaction stream is subjected to an aromatics separation technique two fractions result. One fraction has a higher level of aromatics relative to the stream before separation and is thus referred to as the aromatics-rich fraction. The other fraction is, of course, the aromatics-lean fraction which can also be referred to as the paraffin-rich fraction. Aromatics separation can be accomplished by extraction, extractive distillation, distillation, adsorption, and by permeation through a semipermeable membrane, or by any other appropriate aromatics or paraffins removal process. Preferred is use of a semipermeable membrane. Both the aromatics-rich and the aromatics-lean streams will also contain paraffinic and naphthenic material. The aromatics-rich stream, because of the relatively high level of aromatic components, has a relatively high octane value. Such a high octane stream, which exits the separation unit via line 26, can be used as a high octane blending stock or it can be used as a source of raw material for chemical feedstocks. The aromatics-lean stream exits the separation unit via line 28 where it is mixed with the hydrogen-rich gaseous product of the first stage via line 29, which passes from the separator and through pressure reduction valve 27, then to a second reforming stage by passing it through furnace $F_3$ via line 30 where it is heated to reforming temperatures.

The heated aromatics-lean stream from furnace $F_3$ is introduced into reactor $R_3$ via line 32. The reaction stream from reactor $R_3$ is then passed to furnace $F_4$ via line 34 then to reactor $R_4$ via line 36. Reactors $R_3$ and $R_4$ also contain a reforming catalyst which may or may not be the same as the catalyst composition used in the first reforming stage. Furthermore, any reactor, or portion thereof, of any stage may contain a reforming catalyst different than that of any other reactor so long as at least one reactor of a downstream stage contains: (i) a multimetallic, noble-metal containing reforming catalyst, or (ii) a noble-metal containing catalyst wherein the support material is a crystalline aluminosilicate material. Product from reactor $R_4$ is passed to cooler $K_2$ via line 38 where it is cooled and sent via line 40 to separator $S_2$ where it is separated into a liquid stream 42 and a hydrogen-rich make-gas stream 44 which is passed through compressor $C_2$ after which it leaves the process unit or can be recycled to the process unit. It is preferred that the second stage be operated in cyclic mode with swing reactor $R_5$, regeneration gas heater $F_5$, compressor $C_3$, and cooler $K_3$. The second stage, as well as any additional downstream stages, is operated at a pressure at least 25 psig lower than the first stage, more preferably at a pressure less than about 200 psig total pressure, and most preferably less than 100 psig total pressure. While the figure shows only two reactors on oil for both stages, it is understood that any number of reactors can be used. Of course, economics will dictate the number of reactors and stages employed commercially.

It is also to be understood that the figure hereof sets forth a preferred mode of practicing the instant invention and as such, many variations of the process scheme illustrated in the figure can be practiced and still be within the scope of the invention. For example, at least a portion of the reaction stream from stage two can be recycled through the aromatics separation unit between stages one and two or it can be separated in an aromatics separation unit following stage two and the resulting aromatics-lean stream recycled to the second stage reactors. Further, a three stage reforming process can be employed with an aromatics separation unit between stages one and two as well as an aromatics separation unit following the third stage with the resulting aromatics-lean stream from this third aromatics separation unit recycled to the reactors of the third stage. Also, the same aromatics-separation unit can be used to produce an aromatics-rich and aromatics-lean stream from more than one reactor.

Catalysts suitable for use herein include both monofunctional and bifunctional multimetallic Pt-containing reforming catalysts. Preferred are the bifunctional reforming catalysts comprised of a hydrogenation-dehydrogenation function and a acid function. The acid function, which is important for isomerization reactions, is thought to be associated with a material of the porous, adsorptive, refractory oxide type which serves as the support, or carrier, for the metal component, usually a Group VIII noble metal, to which is generally attributed the hydrogenation-dehydrogenation function. The support material may also be a crystalline aluminosilicate such as a zeolite. Non-limiting examples of zeolites which may be used herein include those having an effective pore diameter, particularly L-zeolites, zeolite X, and zeolite Y. Preferably the Group VIII noble metal is platinum. One or more promoter metals selected from metals of Groups IIIA, IVA, IB, VIB, and VIIB of the Periodic Table of the Elements may also be present. The promoter metal, can be present in the form of an oxide, sulfide, or elemental state in an amount from about 0.01 to about 5 wt. %, preferably from about 0.1 to about 3 wt. %, and more preferably from about 0.2 to about 3 wt. %, calculated on an elemental basis, and based on the total weight of the catalyst composition. It is also preferred that the catalyst compositions have a relatively high surface area, for example, about 100 to 250 $m^2/g$. The Periodic Table of which all the Groups herein refer to can be found on the last page of *Advanced Inorganic Chemistry,* 2nd Edition, 1966, Interscience Publishers, by Cotton and Wilkinson.

The halide component which contributes to the necessary acid functionality of the catalyst may be fluoride, chloride, iodide, bromide, or mixtures thereof. Of these, fluoride and, particularly, chloride are preferred. Generally, the amount of halide is such that the final catalyst composition will contain from about 0.1 to about 3.5 wt. %, preferably about 0.5 to about 1.5 wt. % of halogen calculated on an elemental basis.

Preferably, the platinum group metal will be present on the catalyst in an amount from about 0.01 to about 5 wt. %, calculated on an elemental basis, of the final catalytic composition. More preferably the catalyst comprises from about 0.1 to about 2 wt. % platinum group component, especially about 0.1 to 2 wt. % platinum. Other preferred platinum group metals include palladium, iridium, rhodium, osmium, ruthenium and mixtures thereof.

As previously mentioned, aromatics removal can be accomplished by extraction, extractive distillation, distillation, adsorption, by use of semipermeable membrane or any other appropriate method for the removal of aromatics or paraffins. Preferred is use of a semipermeable membrane.

Semipermeable membranes suitable for use herein are those which are compatible with the reaction stream and which preferentially permeate the aromatic components of the feed stream at an adequate and sustainable rate. Non-limiting examples of membranes which meet these requirements include those made from polyurea, polyurethane, and polyurea/urethanes.

The membranes used in the practice of the present invention may be cast in any thickness, membranes ranging in thickness of from about 0.1 to about 50 microns, preferably from about 0.1 to about 20 microns, and more preferably from about 0.1 to about 10 microns.

The separation techniques used herein with membranes could include either perstraction or pervaporation. Perstraction involves the selective dissolution of particular components contained in a mixture into the membrane, the diffusion of those components through the membrane and the removal of the diffused components from the downstream side of the membrane by use of a liquid sweep stream. In the perstractive separation of aromatics from non-aromatics, the aromatic molecules present in the stream dissolve into the membrane film due to similarities between the membrane solubility parameter and those of the aromatic species in the stream. The aromatics then permeate (diffuse) through the membrane and are swept away by a sweep liquid which is low in aromatics content. This keeps the concentration of aromatics at the permeate side of the membrane film low and maintains the concentration gradient which is responsible for the permeation of the aromatics through the membrane.

The sweep liquid is low in aromatics content so as not to itself decrease the concentration gradient. The sweep liquid is preferably a saturated hydrocarbon liquid with a boiling point much lower or much higher than that of the permeated aromatics. This is to facilitate separation, as by simple distillation. Suitable sweep liquids, therefore, would include, for example, $C_3$ to $C_6$ saturated hydrocarbons.

The perstraction process is run at a temperature 40°–100° C., preferably as low as practical to enhance membrane stability and life.

The choice of pressure is not critical since the perstraction process is not dependent on pressure, but on the ability of the aromatic components in the feed to dissolve into and migrate through the membrane under a concentration driving force. Consequently, any convenient pressure may be employed which pressure is determined by the hydrodynamics and configuration of the permeator used. Lower pressures are preferred to avoid undesirable compaction, if the membrane is supported on a porous backing, or rupture of the membrane, if it is not.

If $C_3$ or $C_4$ sweep liquids are used at 25° C. or above in the liquid state, the pressure must be increased to keep them in the liquid phase.

Pervaporation, by comparison, is run at generally higher temperatures than perstraction to enhance aromatics permeation and relies on vacuum on the permeate side to evaporate the permeate from the surface of the membrane and maintain the concentration gradient driving force which drives the separation process. As in perstraction the aromatic molecules present in the stream dissolve into the membrane film, permeate (diffuse) through said film and emerge on the permeate side where the aromatic molecules are removed by the vacuum generating equipment. Pervaporative separation of aromatics from non-aromatics of the reformate streams of the present invention are performed at an effective temperature. That is, at a temperature that is not so high as to cause physical damage to the membrane or to result in an undesirable loss of selectivity. This temperature will usually range from about 80° to 120° C. Vacuum on the order of about 1–50 mm Hg is pulled on the permeate side. The vacuum stream containing the permeate is cooled to condense the highly aromatic permeate.

The membrane itself may be in any convenient form utilizing any convenient permeator design. Thus, sheets of membrane material may be used in spiral wound or plate and frame permeators. Tubes or hollow fibers of membranes may be used in bundled configurations. Feed can be processed either in the internal space of the tubes or fibers or the outside of the tubes or fibers. The sweep liquid, in the perstraction case, or the vacuum, in the pervaporation case, will be in the space opposite the feed.

Most conveniently, for the instant process, the membrane is used in a hollow fiber configuration with the feed introduced on the inside of the fiber and vacuum pulled on the outside of the hollow fiber to sweep away the permeated species, thereby maintaining a concentration gradient. The permeated aromatics-rich stream is condensed and collected, as a product. The retentate, or aromatics-lean stream, continues on to the next reforming stage.

By practice of the present invention, reforming is conducted more efficiently and results in increased hydrogen and $C_5+$ liquid yields. That is, the reactors upstream of aromatics separation are operated at conventional reforming temperatures and pressures while the reactors downstream of the aromatics removal, because of the removal of a substantial portion of feed as an aromatics-rich stream, can be operated at lower pressures, for example at pressures as low as from about 30 to about 100 psig. In addition, because of the removal of this aromatics-rich stream, the reactors downstream to its removal can be operated without recycling hydrogen-rich make-gas. That is, the downstream reactors can be operated in once-through hydrogen-rich gas mode because a sufficient amount of hydrogen is generated in the downstream reactors, that when combined with the hydrogen-rich gas from the reactors of the previous stage, there is an adequate amount of hydrogen to sustain the reforming reactions taking place in the downstream reactors.

The pressure drop in the downstream reactors can be reduced by operating in the once-through hydrogen-rich gas mode, thereby allowing for a smaller product-gas compressor ($C_2$ in the Figure) than would otherwise be required. Furthermore, operating in a once-through hydrogen-rich gas mode also eliminates the need for a recycle gas compressor to circulate the hydrogen-rich make-gas in the downstream reactors.

Further, as previously discussed, practice of the present invention allows for a dual mode of operation wherein the stage upstream of aromatics separation can be operated in semiregenerative mode and the stage downstream of aromatics separation can be operated in cyclic mode. The frequency of regeneration of the downstream stage is decreased because the aromatics-lean stream is less susceptible to coking when compared with a conventional reforming reaction stream. A still further benefit of the instant invention is the fact that two octane streams are produced. The aromatics-rich stream is exceptionally high in octane number, for example, up to about 108 RON, or higher, and the octane number of the product stream from the downstream stage is flexible depending on the octane requirements for gasoline blending. These two independent octane streams allow for increased flexibility.

Another benefit of the present invention is that by operating the downstream reactors at lower octane severity, one is able to achieve lower coking rates, and thus longer catalyst life between regenerations. This lower severity also results in less undesirable polynuclear aromatic side products. An additional benefit of the present invention is that the aromatics-rich stream can be more easily separated into high value chemicals feedstocks such as benzene, toluene, and xylene.

The present invention will be more fully understood, and appreciated by reference to the following examples based on computer model predictions and are presented for illustrative purposes and not intended to define the scope of the invention.

EXAMPLES

Two sets of experiments were generated by a computer model of the reforming process. The first set, Comparative Example A and Example 1, are conducted at relatively high pressures whereas the second set, Comparative Example B and Example 2, are conducted at relatively low pressures. The feed for the first set of data is a 185°/330° F. cut petroleum naphtha comprised of 59 vol. % paraffins, 27 vol. % naphthenes, and 14 vol. % aromatics. The feed for the second set of data is also a 185°/330° F. cut petroleum naphtha, but it is comprised of 50 vol. % paraffins, 38 vol. naphthenes, and 12 vol. % aromatics. The table below sets forth reaction conditions and predicted results.

| Example | Comp. A | 1 | Comp. B | 2 |
|---|---|---|---|---|
| # Stages | 1 | 2 | 1 | 2 |
| Pressure, psig | | | | |
| 1st Stage | 420 | 325 | 190 | 190 |
| 2nd Stage | — | 85 | — | 50 |
| 1st Stage Recycle Gas Rate, SCF/B | 3 | 2 | 2 | 2 |
| 2nd Stage $H_2$:$C_5$+ Ratio | — | 2:1 | — | 2:1 |
| Cycle Length, Months | | | | |
| 1st Stage | 2.5 | 6 | Cyclic | 6 |
| 2nd Stage | — | Cyclic | — | Cyclic |
| $C_5$+ Octane, RONC | | | | |
| 1st Stage | 100 | 85 | 98 | 85 |
| 2nd Stage | — | 93 | — | 91 |
| Aromatics Product | — | 106 | — | 106 |
| Total Blended, RONC | 100 | 100 | 98 | 98 |
| Overall Yields | | | | |
| $H_2$, Wt. % | 1.9 | 2.2 | 2.4 | 2.9 |
| $C_1$, Wt. % | 2.3 | 1.5 | 1.7 | 1.0 |
| $C_2$, Wt. % | 4.2 | 2.7 | 3.0 | 1.8 |
| $C_3$, Wt. % | 5.2 | 3.3 | 3.7 | 2.2 |
| $nC_4$, Wt. % | 4.2 | 2.7 | 3.2 | 1.7 |
| $iC_4$, Wt. % | 2.8 | 1.9 | 2.0 | 1.3 |
| $C_5$+, Wt. % | 79.4 | 85.7 | 84.0 | 89.1 |
| $C_5$+, LV % | 74.0 | 79.9 | 78.2 | 82.7 |

What is claimed is:

1. A process for catalytically reforming a gasoline boiling range hydrocarbonaceous feedstock in the presence of hydrogen in a reforming process unit comprised of a plurality of serially connected reactors wherein each of the reactors contains a supported noble metal-containing reforming catalyst compositon, the process comprising:

(a) conducting the reforming it two or more stages comprised of one or more reactors;

(b) separating aromatics from at least a portion of the reaction stream between each stage thereby resulting in an aromatics-rich stream and an aromtics-lean stream;

(c) passing at least a portion of the aromatics-lean stream to the next downstream stage, in the substantial absence of non-reformed feed; and (d) conducting the reforming of one or more of the downstream stages wherein at least one of the reactors contains a reforming catalyst selected from (i) a supported multi-metallic catalyst wherein at least one of the metals is a noble metal, and the support is alumina, and (ii) a noble metal-containing catalyst wherein the support material is a crystalline aluminosilicate material, and wherein at least one downstream reactor is operated in the substantial absence of steam, and at a pressure which is at least 25 psig lower than that of the first stage.

2. The process of claim 1 wherein the one or more reactors of the downstream stages is operated at a pressure of 200 psig or lower.

3. The process of claim 1 wherein the one or more reactors of the downstream stages are operated at a pressure of 100 psig or lower.

4. The process of claim 1 wherein the aromatics are separated by permeation by use of a semipermeable membrane.

5. The process of claim 4 wherein the semipermeable membrane is comprised of a material selected from the groups consisting of polyureas, polyurethanes, and polyurea/urethanes.

6. The process of claim 5 wherein the membrane material is a polyurea/urethane or a polyurethane.

7. The process of claim 6 wherein the membrane is a polyurea/urethane.

8. The process of claim 7 wherein one or more of the reactors of the downstream stages are operated at a pressure of 200 psig or lower.

9. The process of claim 8 wherein one or more of the reactors of the downstream stages are operated at a pressure of 100 psig or lower.

10. The process of claim 1 wherein the reforming catalyst composition in one or more of the reactors is comprised of: platinum, a halide and at least one metal selected from Group VIII noble metals, Groups IIIA, IVA, IB, VIB, and VIIB, and an inorganic oxide support; or a Group VIII noble metal and a crystalline aluminosilicate support.

11. The process of claim 10 wherein the reforming catalyst composition is comprised of a platinum and one or more Group VIII noble metals, a halide, and an inorganic oxide or zeolitic support.

12. The process of claim 4 wherein the reforming catalyst composition in one or more of the reactors is comprised of: platinum, a halide and at least one other metal selected from Group VIII noble metals, Groups IIIA, IVA, IB, VIB, and VIIB, and an inorganic oxide support; or a Group VIII noble metal and a crystalline aluminosilicate support.

13. The process of claim 1 wherein one or more of the downstream stages are operated such that the hydrogen-rich gaseous product is not recycled.

14. The process of claim 4 wherein one or more of the downstream stages are operated such that the hydrogen-rich gaseous product is not recycled.

15. The process of claim 11 wherein one or more of the downstream stages are operated such that the hydrogen-rich gaseous product is not recycled.

16. The process of claim 15 wherein the first stage is operated in semiregenerative mode and the second stage is operated in cyclic mode.

17. The process of claim 1 wherein one or more of the reactors are operated in continuous mode.

18. The process of claim 5 wherein one or more of the reactors is operated in continuous mode.

19. The process of claim 5 wherein aromatics are also separated from the reaction stream from the last stage.

20. The process of claim 1 wherein the number of stages is two.

21. The process of claim 20 wherein aromatics are also separated from the reaction product stream from the second stage and at least a portion of the resulting aromatics-lean stream is recycled to the second stage.

22. The process of claim 20 wherein aromatics are also separated from the reaction product stream from any one or more of the stages and at least a portion of the resulting aromatics-lean stream is recycled to any one or more of the stages.

23. The process of claim 20 wherein a portion of the reaction product stream from stage two is recycled to the aromatics separation unit between stages one and two.

24. The process of claim 1 wherein a portion of the reaction product stream from any one or more of the stages is recycled to the aromatics separation unit between any one or more of the stages.

25. The process of claim 20 wherein the second stage is operated such that gaseous product is not recycled.

26. The process of claim 25 wherein the second stage is operated at a pressure of at least 25 psig lower than the first stage.

27. The process of claim 20 wherein the first stage is operated in semiregenerative mode and the second stage is operated in cyclic mode.

28. A process for catalytically reforming a gasoline boiling range hydrocarbonaceous feedstock in the presence of hydrogen in a reforming process unit comprised of a plurality of serially connected reactors wherein each of the reactors contains a noble-metal catalyst composition comprised of at least one noble metal and an alumina or crystalline aluminosilicate support, the process comprising:

(a) conducting the reforming in two stages which are separated from each other by an aromatics separation unit which accomplishes separation of aromatics by permeation by use of a semipermeable membrane, wherein each stage includes one or more reactors;

(b) separating, in the aromatics separation unit, at least a portion of the reaction product stream between stages into an aromatics-rich stream and an aromatics-lean stream, wherein at least a portion of the aromatics-lean stream is passed to the next stage, recycled, or collected; in the substantial absence of non-reformed feed, (c) controlling the reforming severity of the first stage to achieve substantial conversion of naphthenes to aromatics with minimum conversion of paraffins; and (d) operating the second stage: in the substantial absence of steam; and at a pressure of at least 25 psig lower than the first stage.

29. The process of claim 28 wherein the second stage is operated a pressure of 200 psig or lower.

30. The process of claim 28 wherein the semipermeable membrane is comprised of a material selected from the group consisting of polyureas, polyurethanes, and polyurea/urethanes.

31. The process of claim 28 wherein the catalyst composition of one or more of the reactors is comprised of a Group VIII noble metal, a halide, and an inorganic oxide support.

32. The process of claim 31 wherein the catalyst composition is one or more of the reactors is comprised of: platinum, a halide and at least one metal selected from Group VIII noble metals, Groups IIIA, IVA, IB, VIB, and VIIB, and an inorganic oxide support.

33. The process of claim 28 wherein gaseous product from the last stage is not recycled and the first stage is operated in semiregenerative mode and the second stage is operated in cyclic mode.

34. The process of claim 32 wherein gaseous product from the last stage is not recycled and the first stage is operated in semiregenerative mode and the second stage is operated in cyclic mode.

* * * * *